US005209175A

United States Patent [19]

Cintron

[11] Patent Number: 5,209,175

[45] Date of Patent: May 11, 1993

[54] EMERGENCY RELEASE DEVICE FOR DRILLING

[75] Inventor: Jose Cintron, Edostado Zulia, Venezuela

[73] Assignee: Lagoven, S.A., Caracas, Venezuela

[21] Appl. No.: 759,672

[22] Filed: Sep. 13, 1991

[51] Int. Cl.[5] ..... B63B 21/50

[52] U.S. Cl. ..... 114/221 A; 30/92; 83/639.1

[58] Field of Search ..... 114/221 R, 221 A; 30/52, 277.4; 83/557, 561, 562, 586, 639.1, 639.2, 639.3

[56] References Cited

U.S. PATENT DOCUMENTS 2,384,130 9/1945 Pell et al. ..... 83/639.1 X
2,578,582 12/1951 Northcutt ..... 30/52
3,150,551 9/1964 Spengler et al. ..... 83/639.1
3,561,526 2/1971 Williams et al. ..... 83/639.1
3,971,328 7/1976 Edling et al. ..... 114/221 R

FOREIGN PATENT DOCUMENTS 2074491 11/1981 United Kingdom ..... 30/92

*Primary Examiner*—Sherman Basinger
*Attorney, Agent, or Firm*—Bachman & LaPointe

[57] ABSTRACT

A system for severing anchor cable mooring lines and oil well drill pipes is disclosed in which a primary hydraulic system containing a first fluid under pressure is utilized to actuate cutters and a secondary hydraulic system containing a second fluid under pressure is used to control valves which regulate the application of the first fluid to the cutters. The system is designed to operate independently of local power sources during an emergency.

14 Claims, 4 Drawing Sheets

EMERGENCY RELEASE DEVICE FOR DRILLING

FIELD OF THE INVENTION

The present invention relates to drilling operations and relates, in particular, to onshore and offshore development and recovery of oil and gas wells.

BACKGROUND OF THE INVENTION

In the course of well drilling operations which are inherently dangerous, emergency situations arise which require immediate and reliable action to save lives and equipment. For example, in offshore drilling rigs, a variety of floating support equipment in the form of barges, floating barracks, supply ships and the like are moored to or anchored alongside a drilling platform.

Upon the occurrence of a well "blow out" the atmosphere surrounding the platform is filled with highly flammable oil, gas and oil-gas mixtures.

In these circumstances it is necessary to release immediately all floating equipment tethered, moored or at anchor.

It is also important to release said floating equipment by means which are dependable, independently of the internal electrical system of the floating equipment involved and in a manner which does not ignite the flammable atmosphere.

Reliability of the release equipment is paramount. That is, the release equipment should not be dependent upon electrical power sources such as battery banks, local distribution systems, motor-generator sets including telemetric radio or acoustic devices, all of which may be inoperative in time of emergency.

SUMMARY OF THE INVENTION

Consequently, it is a primary purpose of the present invention to provide a control system for emergency use and operation to sever anchor chains, mooring cables, drill pipes and other tethering devices.

A further feature of the invention is the provision of such a system that does not rely on local municipal or private electrical power during emergency operations.

That is, it is anticipated that the system of the present invention may utilize electrical or internal combustion engine power sources to bring the system to a state of readiness, but the system is designed to operate in emergencies free of such power sources.

A further feature of the invention is the provision of a control system of the class described which is portable onshore or offshore.

A still further feature of the invention is the provision of such a control system which can be activated in emergency situations by remote control.

It is a still further feature of the present invention to provide an emergency severing system which includes a first hydraulic circuit and a second pneumatic circuit.

A still further feature of the invention is the provision of a first pressurized medium under pressure in the first circuit and a second pressurized medium under pressure in the second circuit.

The language "pressurized medium" is intended to denote conduits containing liquids, gases or air.

A hydraulic control system for emergency use in onshore and offshore well drilling operations operable to sever anchor chains, mooring cables, drill pipes and other tethering devices where the severing apparatus of the system is initiated and operated independently of local electrical power sources embracing certain principles of the present invention may comprise a metal cutting means, circuit means containing pressurized medium, pressurized medium actuation means for actuating the cutting means, at least one pressure vessel in communication with said first means and with the actuation means, means for maintaining said pressurized medium in said pressure vessel at a pressure level sufficient to actuate said actuation means for further actuating at least one cutting means, valve means in communication with said first circuit means, with said pressure vessel and with said actuation means for applying fluid pressure to said cutting means, and trigger means for operating said valve means in rapid fashion.

A process embracing certain other principles of the invention may comprise the steps of providing hydraulically operated cutting means, maintaining a source of pressurized medium under pressure on a standby basis for emergency operation of said cutting means and insuring that the level of pressure of the medium is maintained for emergency operation of the cutting means independently of the availability of local sources of power.

Other features and advantages of the present invention will become more apparent from an examination of the appended drawings when read in conjunction with the succeeding specification in which:

DESCRIPTION OF THE INVENTION

Figure 1:
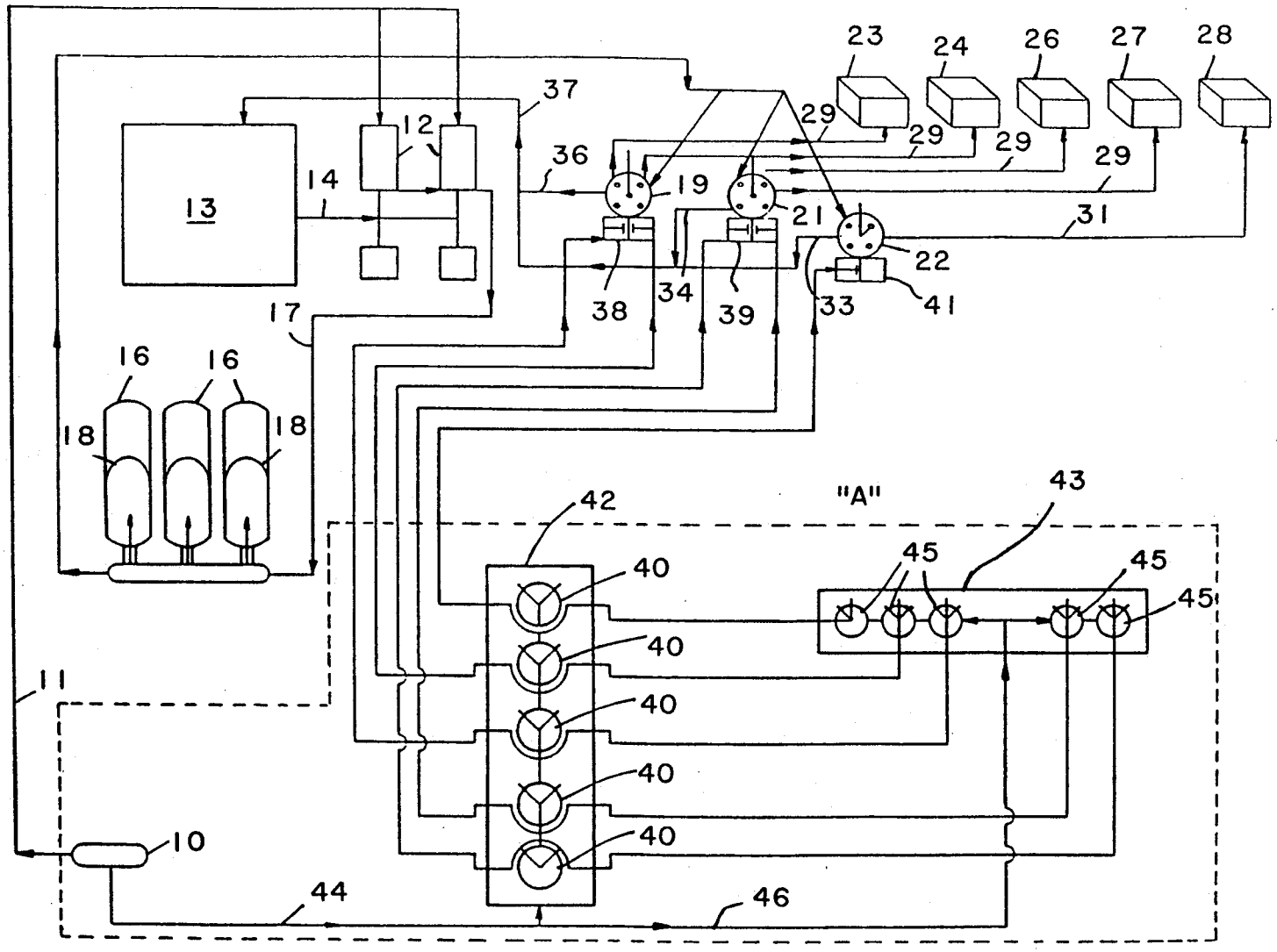
FIG. 1 is a schematic layout of the emergency severing system.

Air is accumulated and pressurized to about 100 to 140 p.s.i., preferably 120 p.s.i., by a suitable compressor (not shown) in air accumulator 10.

The compressed air is directed via conduit 11 to a pair of pneumatic (air) pumps 12—12.

The pumps 12 are actuated to take suction from an oil reservoir 13 via conduits 14 delivering oil under pressure to a plurality of pressure vessels 16—16 via conduit 17.

The oil (first pressurized medium circuit) is pressured to a level of between 3000 to 5000 p.s.i., preferably approximately 5000 p.s.i., by the pumps 12 against an elastic bladder or diaphragm 18 backed by a gas such as nitrogen.

The oil under pressure is led from the pressure vessels 16—16 to three four-way valves 19, 21 and 22, the operation of which directs oil under pressure to cable or chain cutting or severing units indicated generally by the reference numerals 23, 24, 26 and 27 and to drill pipe cutting unit 28 via conduits 29 and 31, respectively.

Note that valve 19 directs high pressure operating oil to cutters 23 and 24 and valve 21 directs oil pressure to cutters 26 and 27 while valve 22 directs oil under pressure to drill pipe cutter 28.

Each valve 19, 21 and 22 has a neutral position in which oil pressure is maintained but poised to deliver fluid to respective cutters upon the occurrence of an emergency.

In addition, each valve 19, 21 and 22 has a by-pass position operative after actuation of the respective cutters 23, 24, 26, 27 and 28 for returning oil to the oil reservoir 13 via conduits 33, 34 and 36 and return pipe 37. In this fashion, the oil system remains a closed circuit and the oil source is continuously replenished available for pressurization by means of air pumps 12—12.

The valves 19, 21 and 22 are operated (indexed) by trigger means preferably comprising air operated actuators 38, 39 and 41, respectively, operated manually by controls 40 on a fixed control board 42 or remotely by controls 45 on a portable control board 43. Preferably, the trigger means will be operable to actuate a plurality of cutting means simultaneously.

Air (second pressurized medium circuit) for the operation of the air actuators is supplied from air accumulator 10 via conduits 44 and 46 and the respective control boards 42 and 43.

Each valve 19, 21 and 22 is indexed to four different positions as the circumstances require. As stated previously, each valve 19, 21 and 22 has a closed position, a discharge position for returning fluid to the reservoirs 18 after actuation of cutters and two (2) positions for supplying oil pressure to cutters.

Note that valves 19 and 21 feed cutters 23–24 and 26–27, respectively, while the supply position of valve 22 is twofold, (two outlets) directed to drill pipe cutter 28 as will be more apparent hereinafter.

Figure 2:
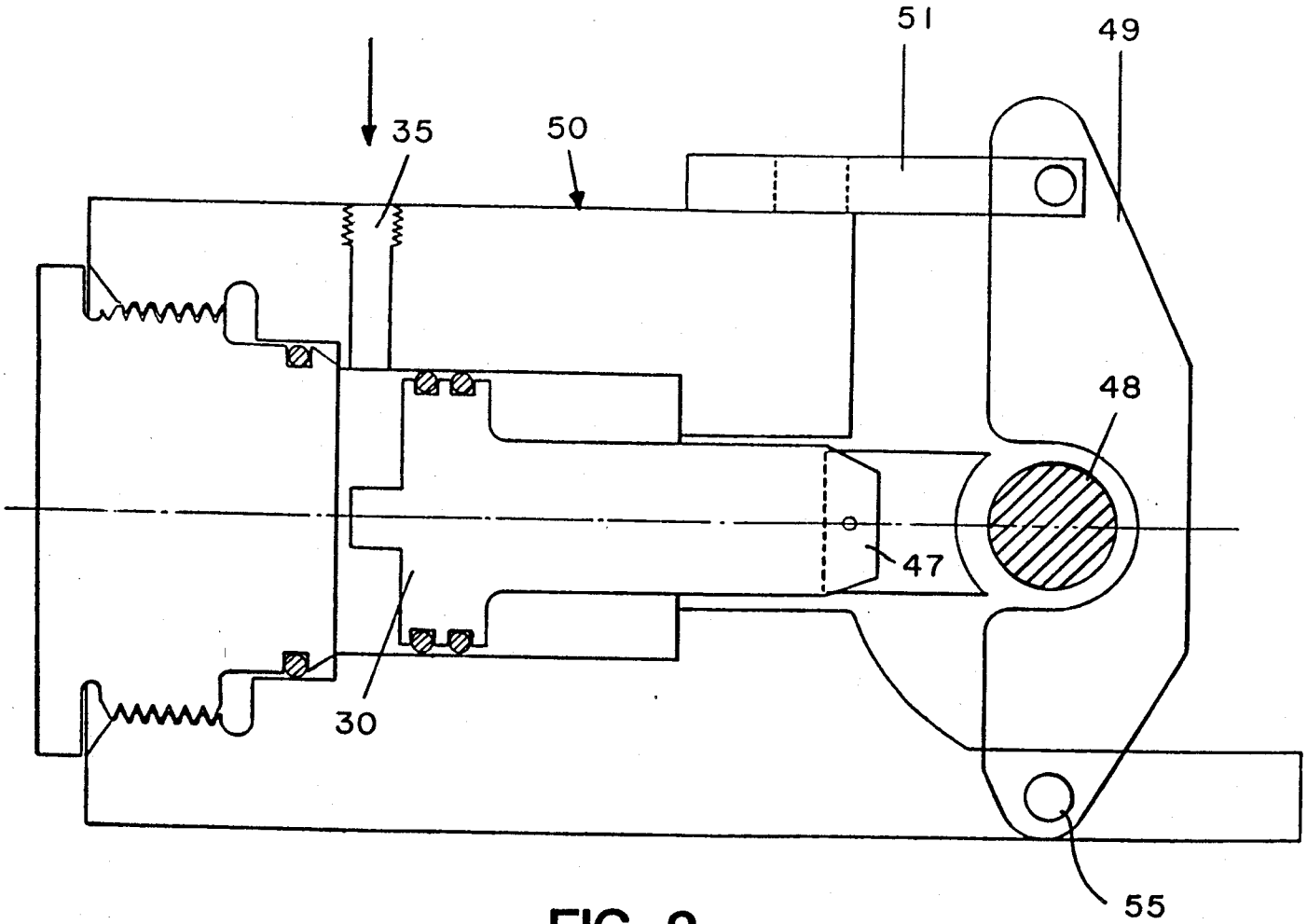
FIG. 2 is a sectional view of a typical metal cutting unit for cutting cables.

FIG. 2 is an enlarged schematic view of a cable cutter 50 wherein a medium under pressure is directed to passage 35 for actuating a piston 30 supporting a blade 47 for severing cable 48.

The cable rests in an anvil 49, hinged at 55, and held in an operable position by movable latch means 51.

To avoid premature operation of the cable cutter 50, in situations where there is no risk or danger, the anvil can be rotated out of its operative position by releasing the latch means 51.

Figure 3:
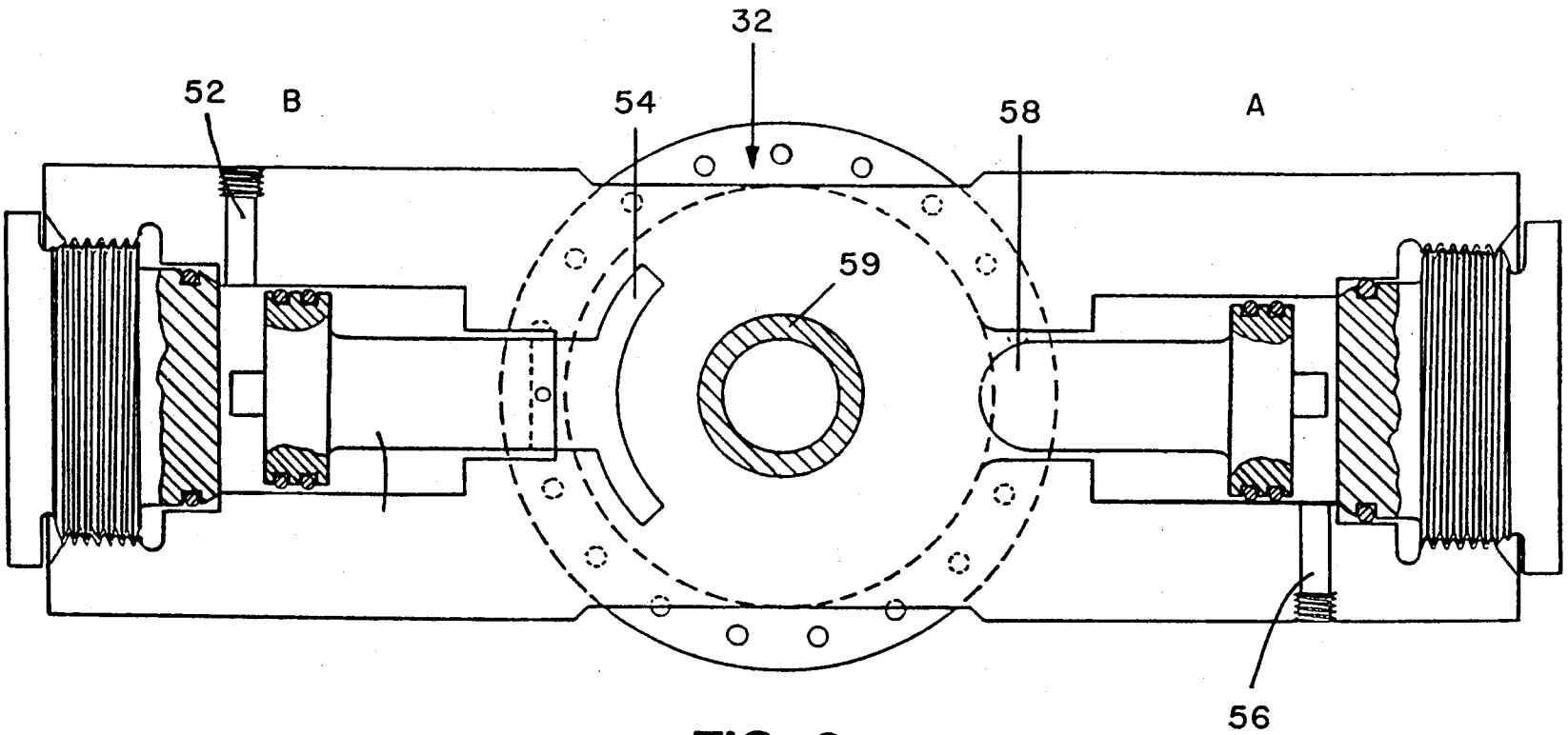
FIG. 3 is a sectional view of a severing unit for cutting drill pipe and the like; and, FIG. 4 is an exploded view of a pivot arm for cutting chains.

FIG. 3 is a schematic illustration of a typical drill pipe cutting means indicated generally by the reference numeral 32 in which valve 22 (FIG. 1) supplies a medium under pressure via passage 52 to a piston 53 supporting an anvil 54. In corresponding fashion, the valve 22 supplies a medium under pressure via passage 56 to a piston 57 supporting a blade 58. Thus, upon the appropriate setting of valve 22, the anvil 54 and the blade 58 are driven toward one another to cut and separate drill pipe 59.

Figure 4:
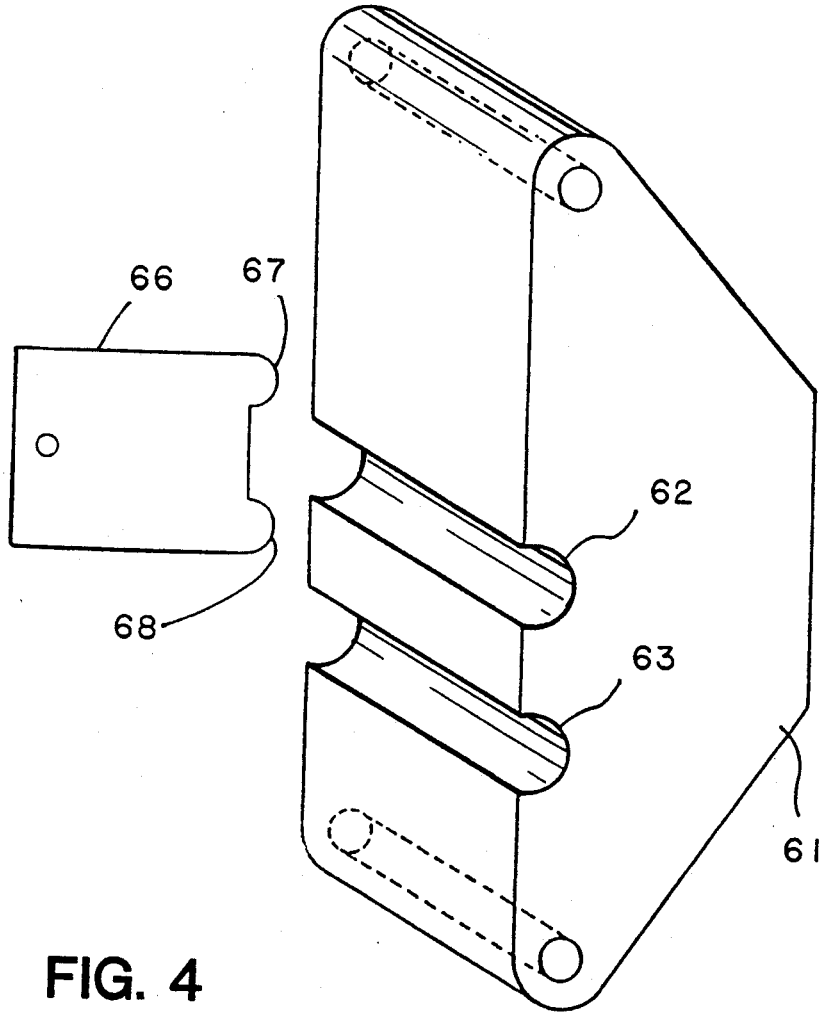

FIG. 4 shows an exploded view, a modification of the anvil 49 of FIG. 2 in which an anvil 61 is formed with parallel grooves 62 and 63 to receive a chain link, not shown.

A blade 66 is provided having cutting elements 67 and 68 for cutting chain link portions disposed in the grooves 62 and 63.

In order to avoid a flash fire or an explosion that may occur as a result of sparks generated by the action of the various cutter devices, the cutters, during the time of a possible emergency, are maintained in an atmosphere of mist or finely divided water spray.

In the alternative, the cutter devices are covered with a viscous material such as grease having a very high flash point.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A control system for emergency use in onshore and offshore well drilling operations operable to sever anchor chains, mooring cables and drill pipes comprising:

a first circuit containing a first pressurized medium;

cutting means connected operatively to said first circuit responsive to said pressurized medium;

a second circuit containing a second pressurized medium;

valve means operatively connected to said first circuit responsive to said second pressurized medium, wherein said valve means comprises a plurality of four-way valves, each valve of said plurality of four-way valves having a closed position, a discharge position for returning said first pressurized medium to a reservoir, and two positions for supplying said first pressurized medium to said cutting means; and pressurized medium valve actuating means in said second circuit responsive to said second pressurized medium for operating said valve means whereby said first pressurized medium is directed to said cutting means for emergency operation of said cutting means.

2. The system of claim 1 wherein the first pressurized medium is at an operating pressure of 3000 p.s.i. to 5000 p.s.i. and the second pressurized medium is at an operating pressure of 100 p.s.i. to 140 p.s.i.

3. A control system for emergency use in onshore and offshore well drilling operations operable to sever anchor chains, mooring cables, drill pipes and other tethering devices where the severing apparatus of the system is initiated and operated independently of local electrical power sources, comprising:

a metal cutting means;

first circuit means containing a first pressurized medium;

pressurized medium means for actuating the cutting means;

at least one pressure vessel in communication with said first circuit means and with said pressurized medium means;

means for maintaining said pressurized medium in said pressure vessel at a pressure level sufficient to actuate said pressurized medium means for further actuating at least one cutting means;

valve means in communication with said first circuit means, with said pressure vessel and with said pressurized medium means for applying medium pressure to said cutting means;

trigger means for operating said valve means in rapid fashion whereby said cutting means is actuated; and wherein said means for maintaining said first pressurized medium in said pressure vessel at a sufficient pressure level comprises at least one pneumatic pump, and wherein said trigger means is a pneumatic trigger means, said system further comprising an air accumulator for supplying pressurized air to said at least one pneumatic pump and to said pneumatic trigger means.

4. The system of claim 3 in which the trigger means is located at a point remote from said cutting means.

5. The system of claim 3 in which the trigger means is operable to activate a plurality of cutting means simultaneously.

6. The system of claim 3 including a plurality of pressure vessels in said first circuit means operable to supply hydraulic fluid via said valve means independently of the availability of a source of electrical power.

7. The control system of claim 3 which is portable onshore and offshore.

8. The control system of claim 3 in which the first circuit means is closed whereby the pressurized medium is recirculated after each operation of said valve means.

9. The system of claim 1 in which the cutting means comprises a blade and hinged anvil and latch means for retaining the anvil releasably in an operative position.

10. The system of claim 9 in which the anvil is formed with spaced grooves for receiving a chain link.

11. The system of claim 1 in which the cutting means comprises a pair of opposed pistons straddling an element to be severed, one piston supporting an anvil and the other piston supporting a blade and hydraulic means for driving said pistons toward one another in unison to accomplish a severing operation.

12. A control system according to claim 3, wherein said trigger means comprises a second circuit containing a pressurized medium and valve actuating means for operating said valve means responsive to said trigger means.

13. A control system according to claim 1, wherein said cutting means comprises a drill pipe cutter and a plurality of cable cutters, said valves means comprising a drill pipe cutter valve for directing said first pressurized medium to said drill pipe cutter, and a plurality of valves, for directing said first pressurized medium to said plurality of cable cutters.

14. A control system for emergency use in onshore and offshore well drilling operations operable to sever anchor chains, mooring cables and drill pipes comprising:

a first circuit containing a first pressurized medium;

cutting means connected operatively to said first circuit responsive to said pressurized medium;

a second circuit containing a second pressurized medium;

valve means operatively connected to said first circuit responsive to said second pressurized medium, wherein said valve means comprises a plurality of four-way valves, each having a first position wherein said first pressurized medium is poised for delivery to said cutting means, a second position wherein said first pressurized medium is conveyed to said cutting means and a third position wherein said first pressurized medium is redirected to a medium reservoir; and wherein said valve actuating means indexes said four-way valves between said first, second and third positions; and pressurized medium valve actuating means in said second circuit responsive to said second pressurized medium for operating said valve means whereby said first pressurized medium is directed to said cutting means for emergency operation of said cutting means.

* * * * *